US007284745B2

(12) United States Patent
Keane et al.

(10) Patent No.: US 7,284,745 B2
(45) Date of Patent: Oct. 23, 2007

(54) PORTABLE RAISING AND LOWERING DEVICE AND EQUIPMENT THEREFOR

(75) Inventors: Brian Keane, Vancouver (CA); Thomas L. Bellaire, Burnaby (CA); Ernie Janzen, North Vancouver (CA); Ryan William Kanigan, Vancouver (CA); Johanne Mattie, Burnaby (CA); Nancy Joan Paris-Seeley, Burnaby (CA); Colin Wilson, Vancouver (CA)

(73) Assignee: British Columbia Institute of Technology, Burnaby, BC (CA)

( * ) Notice: Subject to any disclaimer, the term of this patent is extended or adjusted under 35 U.S.C. 154(b) by 542 days.

(21) Appl. No.: 10/778,119

(22) Filed: Feb. 17, 2004

(65) Prior Publication Data

US 2004/0217078 A1 Nov. 4, 2004

Related U.S. Application Data

(60) Provisional application No. 60/448,564, filed on Feb. 18, 2003.

(51) Int. Cl.
*B66D 1/26* (2006.01)
*A61G 5/00* (2006.01)
*B66C 19/00* (2006.01)

(52) U.S. Cl. ..... 254/372; 254/346; 5/81.1 R; 5/83.1; 212/71; 191/84.3

(58) Field of Classification Search ..... 254/372, 254/346, 365, 358; 212/71; 192/84.3, 223; 188/267; 310/103, 93; 464/30; 5/81.1 R, 5/83, 87.1, 89.1
See application file for complete search history.

(56) References Cited

U.S. PATENT DOCUMENTS

| | | | | | |
|---|---|---|---|---|---|
| 756,454 | A | * | 4/1904 | Astrup | 474/144 |
| 788,606 | A | | 5/1905 | Scott et al. | 192/16 |
| 2,680,203 | A | * | 6/1954 | Zozulin et al. | 310/94 |
| 3,351,959 | A | * | 11/1967 | Turpin | 5/83.1 |
| 3,837,451 | A | * | 9/1974 | Gaillochet | 192/56.43 |
| 4,815,270 | A | | 3/1989 | Lapeyre | 59/84 |
| 5,007,617 | A | * | 4/1991 | Nishimura et al. | 254/372 |
| 5,125,629 | A | * | 6/1992 | Nishimura | 254/358 |
| 5,374,035 | A | * | 12/1994 | Santos | 254/339 |
| 5,631,511 | A | * | 5/1997 | Schulmann et al. | 310/83 |
| 5,779,015 | A | | 7/1998 | Murata | 192/42 |
| 6,019,301 | A | | 2/2000 | Hitomi | 242/247 |
| 6,085,368 | A | * | 7/2000 | Robert et al. | 5/85.1 |

(Continued)

FOREIGN PATENT DOCUMENTS

| | | |
|---|---|---|
| AU | 623 585 | 5/1992 |

(Continued)

*Primary Examiner*—Gene O. Crawford
*Assistant Examiner*—E Langdon
(74) *Attorney, Agent, or Firm*—Fasken Martineau DuMoulin LLP

(57) ABSTRACT

A raising and lowering device, particularly suitable for incapacitated human or animal patients. The device includes a load carrying support having at least one elongated arm including a proximal end section and distal end section. The arm is pivotable on the device at the proximal end section and movable by pivoting between an operating position in which the support is positioned for carrying said load, and a stored position in which the arm forms a graspable handle allowing an operator to carry the device. The invention also relates to components suitable for use with the device.

37 Claims, 14 Drawing Sheets

U.S. PATENT DOCUMENTS

| | | | | |
|---|---|---|---|---|
| 6,179,270 | B1 * | 1/2001 | Higdon | 254/358 |
| 6,481,656 | B2 | 11/2002 | Jeong | 242/247 |
| 6,675,412 | B2 * | 1/2004 | Faucher et al. | 5/83.1 |
| 2004/0217078 | A1 * | 11/2004 | Keane et al. | 212/71 |
| 2006/0278480 | A1 * | 12/2006 | Pardee | 188/218 XL |

FOREIGN PATENT DOCUMENTS

| | | |
|---|---|---|
| EP | 0 812 231 | 10/2001 |
| GB | 2 248 817 | 4/1992 |
| WO | WO 96/33687 | 10/1996 |

* cited by examiner

PORTABLE RAISING AND LOWERING DEVICE AND EQUIPMENT THEREFOR

CROSS-REFERENCE TO RELATED APPLICATION

This application is related to commonly-owned now abandoned, U.S. provisional patent application Ser. No. 60/448,564, filed Feb. 18, 2003, and claims the benefit of the earlier filing date of this application under 35 U.S.C. § 119(e).

FIELD OF THE INVENTION

This invention relates to portable raising and lowering devices often referred to as hoists, winches or lifts. More particularly, although not exclusively, the invention relates to such devices intended for lifting and optionally transporting human or animal patients who are temporarily or permanently incapacitated. The invention also relates to equipment used as parts of, or for operation of, such devices.

DESCRIPTION OF THE PRIOR ART

The present invention relates to raising and lowering devices of all kinds, but it is especially suitable for use in medical or patient care settings for raising and lowering human or animal patients. For the sake of convenience, the invention will be described primarily in this context, but it should be noted that the load to be raised or lowered may be of any kind and is generally a load that is difficult, but usually not impossible, for a single person to move without mechanical assistance.

Incapacitated humans or animals often have to be lifted and transported over short distances for medical procedures or treatments, or merely for everyday functions such as bathing, transfer from a bed to a wheelchair (and vice versa), and the like. Devices intended for lifting and lowering patients in this way are well known and commonly used in homes, offices, extended care facilities, acute care institutions, hospitals, and by home support agencies and the like. Such devices reduce the requirement for heavy lifting by attendants and thus eliminate fatigue and potential injuries for such people and their patients. An early example of a device of this kind is described in U.S. Pat. No. 788,606 which issued on May 2, 1905 to Robert F. Scott et al. (the disclosure of which is incorporated herein by reference).

Raising and lowering devices of this kind normally include an attachment element for attaching the device to an elevated support, such as a ceiling track or fixed anchor (e.g. a hook), a raising and lowering mechanism including a gear train capable of handling the weight of a patient, and a load carrying support for attachment of a sling, straps or other carrying arrangement for directly supporting the patient. Devices of this kind may be electrically driven or manually operable. Once the patient has been secured by the carrying arrangement, the raising and lowering mechanism may be operated to raise the patient from a bed or chair. If the attachment element is secured in a ceiling track or on a rail, the patient can be moved from one location to another over short distances while held in the raised position.

The load carrying support is often a generally horizontal bar having spaced end sections onto which the load carrying arrangement, such as a patient sling, can be attached. The wide separation of the end sections allows for stable attachment of a sling or straps at separated locations. However, the provision of an elongated spreader bar makes the device rather bulky and awkward when it has to be transported from on point of use to another, or merely stored. Moreover, devices provided with electric motors, while convenient, are rather heavy and therefore difficult to transport. It would therefore be advantageous to make such devices lighter, smaller and more easily transportable.

Furthermore, the raising and lowering mechanisms of such devices often include ratchet-like mechanisms (ratchet and pawl arrangements) to hold the patient securely in an elevated position. However, such mechanisms are noisy and can be annoying or disturbing to patients and operators alike.

There is therefore a need for improvement of raising and lowering devices of this kind.

SUMMARY OF THE INVENTION

An object of the present invention, at least in its preferred forms, is to improve raising and lowering devices of the kind to which the present invention relates and/or to provide parts of such devices of improved design or operation.

According to one aspect of the present invention, there is provided a raising and lowering device provided with a raising and lowering mechanism, an attachment element adapted to enable the device to be suspended from an elevated support, and a load-carrying support adapted to support a load to be raised or lowered by the mechanism, wherein the load-carrying support comprises at least one elongated arm having a proximal end section and distal end section, the at least one arm being pivotable on the device at the proximal end section and movable by pivoting between an operating position in which the support is positioned for carrying the load, and a stored position in which the at least one arm forms a graspable handle allowing an operator to carry the device.

Ideally, the load-carrying support comprises two elongated arms, and the distal end sections of the arms are positioned adjacent to each other and together form the graspable handle when the arms are in the stored position. However, in one form of the invention, there is just a single elongated arm that pivots from the operating position to the stored position.

The arms preferably have elongated sections between the proximal and distal end sections, and the distal end sections are preferably oriented at an angle (e.g. in the range of 45 to 135 degrees, and more preferably 90 degrees) to the elongated sections, thereby forming upward projections from the elongated sections when the arms are in the operating position. This provides hook-like elements to prevent patient carrying arrangements from slipping off the arms. The arms preferably have elongated sections between the proximal and distal end sections, and the proximal end sections are preferably orientated at an angle to the elongated sections, thereby forming upward projections from the elongated sections when the arms are in the operating position. Also, the arms preferably have elbow sections where the proximal end sections join the elongated sections, and wherein the elbow sections abut against each other when the arms are in the operating position, thereby preventing downward pivotal motion of the arms.

Normally, during operation of the device, the load-carrying support is positioned beneath the raising and lowering mechanism, and the arms move in a vertical plane when pivoted from the operating position to the stored position, whereupon the distal end sections are positioned above the raising and lowering mechanism when the arms are in the stored position.

The attachment element may be connected to the raising and lowering mechanism by an elongated flexible support member, with the raising and lowering mechanism drawing the flexible support member into the mechanism to raise the load-carrying support, and feeding the flexible support member out of the mechanism to lower the load-carrying support.

Alternatively, the load carrying support may be attached to the raising and lowering mechanism by an elongated flexible support member, and with the raising and lowering mechanism drawing the flexible support member into the mechanism to raise the load-carrying member, and feeding the flexible support member out of the mechanism to lower the load-carrying support. In this case, the load carrying support may include a mechanical linkage connected to the flexible member and carrying the pivotable arms. The proximal end sections of the elongated arms may each be pivotally connected to the mechanical linkage.

Ideally, the elongated arms and the attachment element are positioned on the device in relation to the raising and lowering mechanism to allow the device to hang vertically from an elevated support to provide without tilting. To assist in this, the device of claim 2, wherein the proximal ends of the elongated arms are pivotally attached to a connector member that is itself pivotally attached to the raising and lowering mechanism.

The raising and lowering mechanism may be operated manually, electrically or via detachable electric motor. The mechanism preferably has a rotatable wheel that operates the mechanism when turned, and wherein a flexible element passes around the wheel and forms a dangling loop that is adapted to be grasped and moved by hand. The wheel is normally a sprocket wheel having projecting circumferential sprockets, and the flexible element is a chain having recesses for receiving the sprockets. Preferably, the chain comprises two different kinds of links, the links of the two kinds being arranged in alternating sequence and being pivotally attached to each other in a way that allows adjacent links to be oriented to be coplanar or mutually pivoted about axes that are transverse to the chain, and the links of one of the two kinds being wider in a lateral direction of the chain than the links of the other of the two kinds, thereby creating lateral recesses in side edges of the chain at spaced locations along the chain, and wherein the sprockets project in aligned pairs at opposite edges of a circumference of the sprocket wheel in positions adapted to enter and engage with the recesses as the chain passes around the wheel. Adjacent links may be pivotally attached to each other by laterally extending coaxial pairs of bosses or pins extending between the links. At least one of the adjacent links preferably has sockets for receiving and retaining ends of the bosses or pins, and wherein the sockets have cut-outs allowing snap-fitting together or, alternatively, manual separation of the adjacent links by mutual twisting of the adjacent links. The links are made of a rigid plastics material or alternatively metal, have an outer surface provided with a non-slip finish.

The links of one of the two kinds may be provided with re-entrant sections at each longitudinal end, and wherein the links of the other of the two kinds are elongated and have opposed ends shaped and dimensioned to fit within the re-entrant sections of the links of the one kind. Adjacent links may then be mutually pivotally attached by bosses or pins extending between the links within the re-entrant sections. The links of the other kind are shaped such that two links of the one kind attached at opposite ends of a link of the other kind are enabled to pivot into mutual contact without causing detachment of the pins or permanent deformation of the links.

The raising and lowering mechanism preferably includes a one-way roller bearing for an axle and an axle journaled in the bearing, the bearing allowing mutual rotation between the bearing and the axle in one direction consistent with raising of the load, but preventing mutual rotation in an opposite direction consistent with lowering of the load, thereby enabling the load to be raised to any desired elevation by operation of the raising and lowering mechanism and held at the elevation without lowering upon ceasing operation of the raising and lowering mechanism. The raising and lowering mechanism preferably also includes a magnetic clutch that prevents overload of the raising and lowering mechanism.

According to another aspect of the invention, there is provided a raising and lowering device provided with a raising and lowering mechanism, an attachment element adapted to enable the device to be suspended from an elevated support, a load-carrying support adapted to support a load to be raised or lowered by the mechanism, a drive input for the mechanism and a magnetic clutch between the drive input and the mechanism, the magnetic clutch being adapted to isolate the mechanism from the drive input when a load of more than a predetermined weight is carried by the load-carrying support and lifting of the weight is attempted. Ideally, the magnetic clutch comprises a pair of elements that are rotatable independently of each other, the elements having confronting parts that are mutually magnetically attractive, one of the elements being operably connected to the drive input and the other of the elements being operably connected to the raising and lowering mechanism. These elements may be provided with depressions containing magnets forming the confronting parts. The elements are normally rotatable about aligned axes and the magnets are positioned around each element at substantially equal distances from the axes and the elements may be separated by a spacer element that facilitates mutual rotation of the plates when lifting of the weight is attempted.

According to another aspect of the invention, there is provided a raising and lowering device provided with a raising and lowering mechanism, and a load-carrying support adapted to support a load to be raised or lowered by the mechanism, wherein the raising and lowering mechanism includes a one-way roller bearing for an axle and an axle journaled in the bearing, the bearing allowing mutual rotation between the bearing and the axle in one direction consistent with raising of the load, but preventing mutual rotation in an opposite direction consistent with lowering of the load, thereby enabling the load to be raised to any desired elevation by operation of the raising and lowering mechanism and held at the elevation without lowering upon ceasing operation of the raising and lowering mechanism.

The one-way bearing preferably includes a needle race formed of a plurality of needle rollers positioned between the axle and an encircling bearing shell, the encircling bearing shell having a surface confronting the needle race provided with a succession of recesses separated by lands, whereby mutual rotation of the axle and the bearing in one direction biases the individual rollers to enter the recesses, and mutual rotation in an opposite direction biases the individual rollers to contact the lands, thereby preventing rotation.

According to yet another aspect of the invention, there is provided a raising and lowering device provided with a raising and lowering mechanism, a load-carrying support adapted to support a load to be raised or lowered by the mechanism, and a drive input for the raising and lowering mechanism, wherein the drive input includes a sprocket wheel having outwardly projecting sprockets that operates the raising and lowering mechanism when turned, and an elongated flexible element that engages the sprocket wheel and forms a dangling loop that can be grasped by a user and pulled to turn the sprocket wheel in one direction or another. The sprocket wheel preferably has a circumferential surface with the sprockets projecting at regularly spaced positions around the circumferential surface, some of the sprockets being positioned at one side of the circumferential surface and others of the sprockets being positioned at another side of the circumferential surface, the sprockets on the one side and the sprockets on the another side being arranged in aligned pairs. The flexible element is preferably an elongated element having opposed side edges provided with regularly spaced mutually aligned recesses adapted to receive the aligned pairs of sprockets of the sprocket wheel.

The invention also relates to a drive chain for a raising and lowering device as described above. The drive chain has two different kinds of links arranged in alternating sequence together forming an elongated flexible chain having opposed lateral edges, the links being pivotally attached to each other to allow adjacent links to be oriented so as to be coplanar or mutually pivoted about axes that are transverse to the chain, the links of one of the two kinds being wider in a lateral direction of the chain than the links of the other of the two kinds, thereby creating transversely aligned recesses in the lateral edges at spaced locations along the chain. The links may be in the form of flat bodies that are solid, or the bodies of the links of the one of the two kinds may have rounded lateral sides while the bodies of the links of the other of the two kinds have substantially straight lateral sides.

The invention also relates to a raising and lowering mechanism for a raising and lowering device, the mechanism comprising a rotatable drive input, a gear train driven by the drive input, an elongated flexible support extended or retracted by the gear train, and a reverse-prevention device that permits operation of the gear train only in one direction of movement of the drive input, wherein the reverse-prevention device comprises a one-way roller bearing. An overload clutch may be provided between the drive input and the gear train that allows movement of the drive input without corresponding movement of the gear train when an excessive load is connected to the mechanism. The overload clutch is preferably a magnetic clutch.

In another aspect, the invention provides a magnetic clutch for a raising and lowering device, comprising a drive plate rotatable about an axis, a driven plate rotatable about the axis, a plurality of magnets carried by the drive plate arranged symmetrically around the axis, and a plurality of magnets carried by the driven plate arranged symmetrically about the axis and corresponding in number and positioning to the magnets of the driven plate, wherein the magnets of the drive plate confront the magnets of the driven plate causing a resulting mutual magnetic attraction that forces the driven plate to follow rotation of the drive plate, except when force required to rotate the driven plate overcomes the magnetic attraction.

DETAILED DESCRIPTION OF THE INVENTION

General Description

Figure 1:
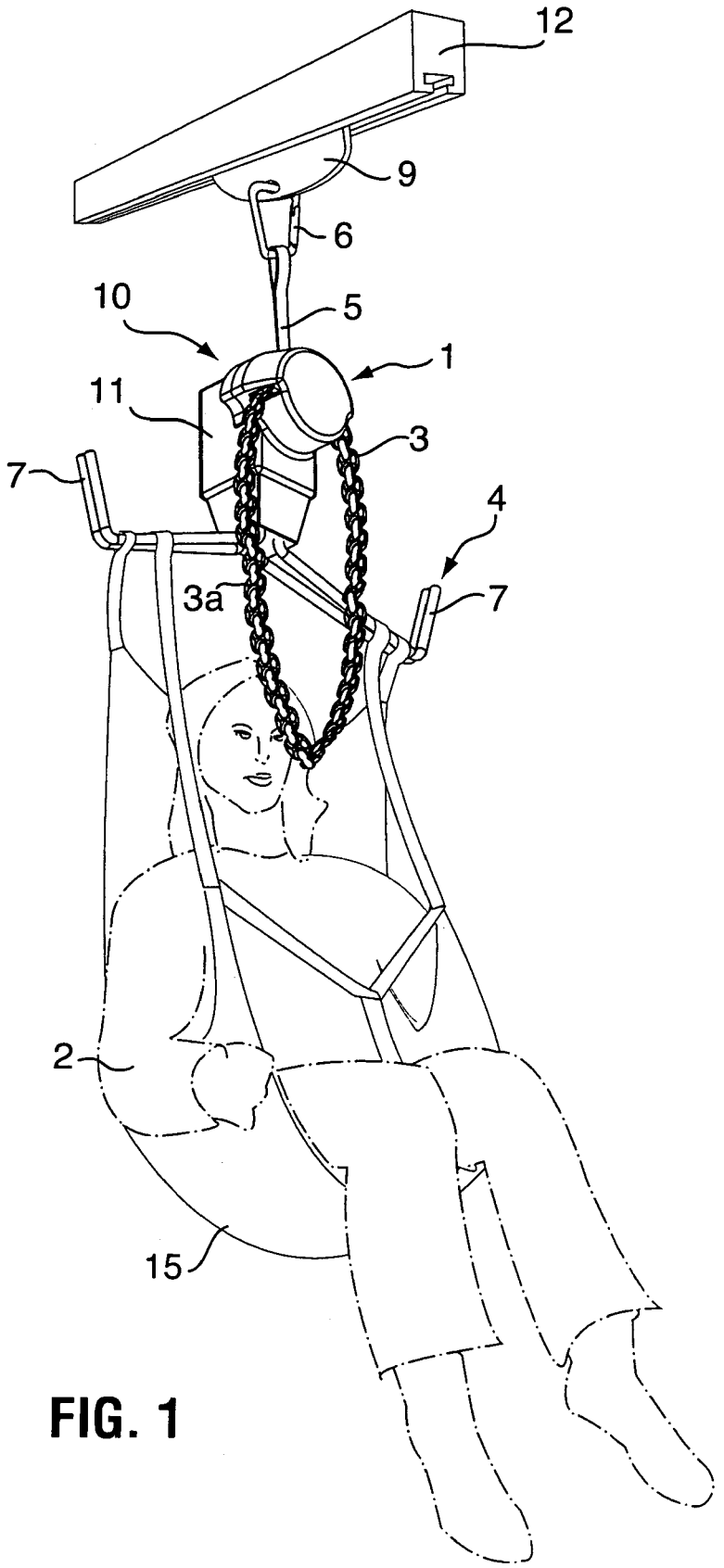
FIG. 1 is a perspective view of one embodiment of the raising and lowering device of the present invention in use lifting a patient.

As shown in FIG. 1 of the accompanying drawings, one form of the present invention comprises a raising and lowering device 10 for a human patient 2. The device 10 is provided with a housing 11 (forming a casing enclosing a raising and lowering mechanism), a flexible elongated member 5, such as a strong flexible but inextensible webbing strap, belt or band, extending from the housing 11 and secured at an opposite (upper) end to an attachment element 6, such as a hook having a releasable locking tongue, that suspends the device from a slider 9 movable in an elevated fixed track 12. The flexible elongated member 5 can be wound and unwound about a reel component forming part of the raising and lowering mechanism within the housing 11 of the device 10 and is configured such that the induced rotation of the reel component by a drive input in one direction or the other leads to the raising or lowering of the housing 11. The drive input may be manually powered by means of a flexible element 3, such as a chain, forming an endless dangling loop 3*a* that can be rotated by the user in either direction and itself causes rotation of the reel component via a gear train in the housing 11 that allows a relatively small pulling force to lift the weight of the patient. The device also includes a load-carrying support 4 in the form of a pair of elongated arms acting as spreader bars 7 pivotally attached to the housing 11. The spreader bars are designed for integration with a patient carrying arrangement in the form of a sling 15.

Figure 2:
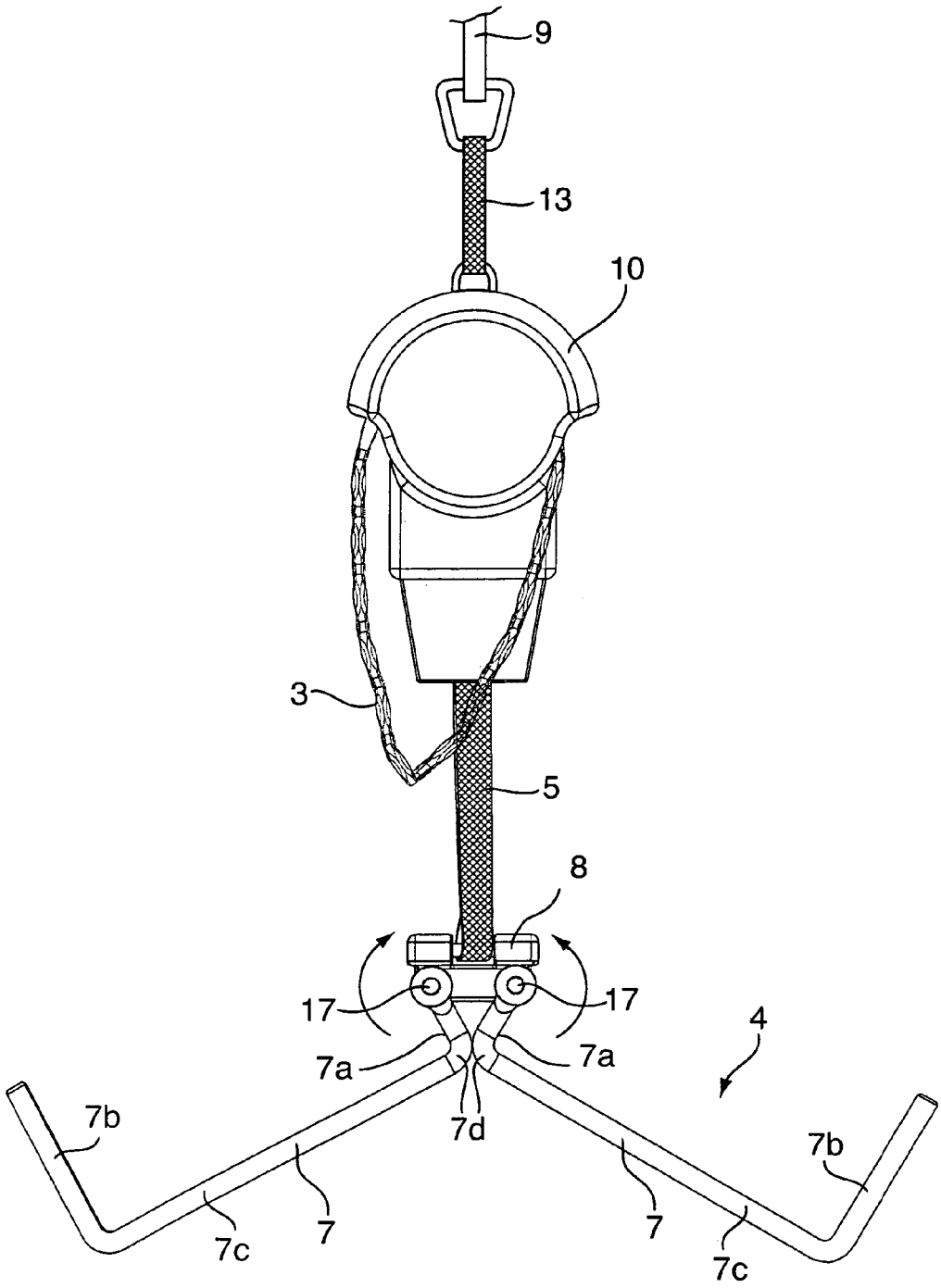
FIG. 2 is a front elevation of an alternative device.

As already noted, the device shown in FIG. 1 is arranged such that the elongated flexible element 5 raises and lowers the housing 11, and thereby raises or lowers the load-carrying support 4 fixed to the housing 11. Alternatively, as shown in FIG. 2, the elongated flexible element 5 may be arranged such that it raises or lowers just the load-carrying support 4 while the housing 11 remains stationary, attached to an elevated support 9 via a connector 13 of fixed length, e.g. a strap or chain. In this case, the spreader bars 7 may be attached to a mechanical linkage 8 that in turn connects the elongated flexible element 5 to the spreader bars 7. As an alternative to the use of a connector 13, the housing 11 may be directly secured to (or integrated as pant of) a support, e.g. a support framework movable on casters or the like (not shown), as in this embodiment the housing 11 does not move vertically during use.

Ergonomic Drive Input

Figure 3A:
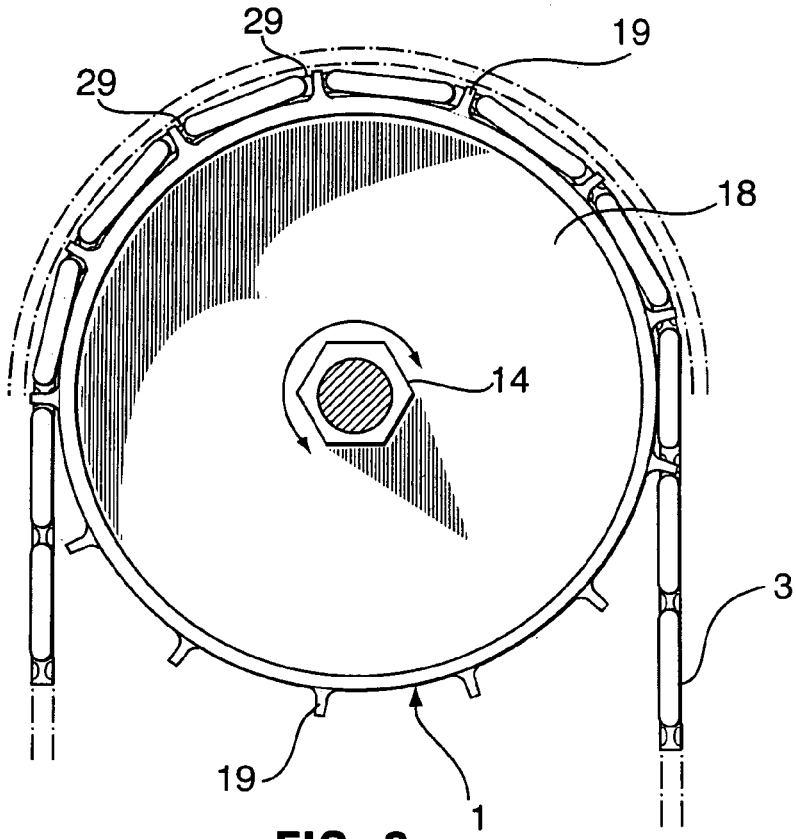
FIG. 3*a* is view of the sprocket wheel and flexible drive element of the embodiment of FIG. 1.
Figure 3B:
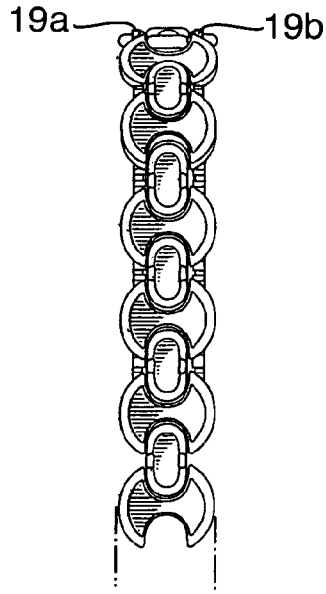
FIG. 3*b* is a side view of the sprocket wheel of FIG. 3*a;*

As shown in FIG. 3*a*, a drive input 1 for the device may be in the form of a sprocket wheel 18 having outwardly projecting circumferential sprockets (teeth) 19 spaced at regular intervals around the periphery of the sprocket wheel. In fact, as shown more clearly in FIG. 3*b*, the sprockets are arranged in transversely aligned pairs 19*a* and 19*b*, one sprocket 19*a* of each pair being provided at the front edge of the wheel rim and the other 19*b* at the rear edge, spaced apart by a part of the cylindrical circumferential surface of the sprocket wheel 18. The sprockets 19*a* and 19*b* engage each side of the flexible element 3 which is in the form of a specialized chain described more fully later. The sprocket wheel 18 is appropriately connected (see later) such that induced rotation of the drive input 1 in one direction leads to the raising of the load carrying support 4, and induced rotation in the opposite direction leads to lowering of the load carrying support 4. For example, a clockwise rotation of the drive input 1 may raise the load carrying support and counter-clockwise rotation of the driven input 1 may lower the load carrying support 4.

The drive input 1 may be configured such that when rotation is ceased, the raising or lowering of the device is also ceased, leaving the load-carrying support 4 securely fixed at any position. The way in which this is achieved is described later.

As previously described, the drive input 1 is operated manually by means of an operator pulling down on one side or the other of the flexible element 3. Alternatively, the drive input 1 may be engaged by means of either a rigid component, such as a handle or crank (not shown) or a turning wheel (not shown). As a further alternative, the drive input 1 may be operated by a small electrical motor (not shown) forming an integral part of the device 10 or, more preferably, forming a separate portable component. For example, a tool similar or identical to an electric screw driver provided with a suitable socket instead of a screw driver blade may be temporarily connected to a central fixed drive element 14 (e.g. a protruding multi-faced nut) on the sprocket wheel 18 and used to turn the wheel in one direction or the other (such electric tools are normally reversible). An arrangement of this kind avoids the need to build an electric drive into the device itself in those cases where power assistance is required, and therefore does not contribute to the weight of the device. Of course, the device may be provided with both a sprocket and chain drive and a central drive element for powered drive so that the user has the option of manual or electrically driven operation.

Ergonomic Chain

Figure 4A:
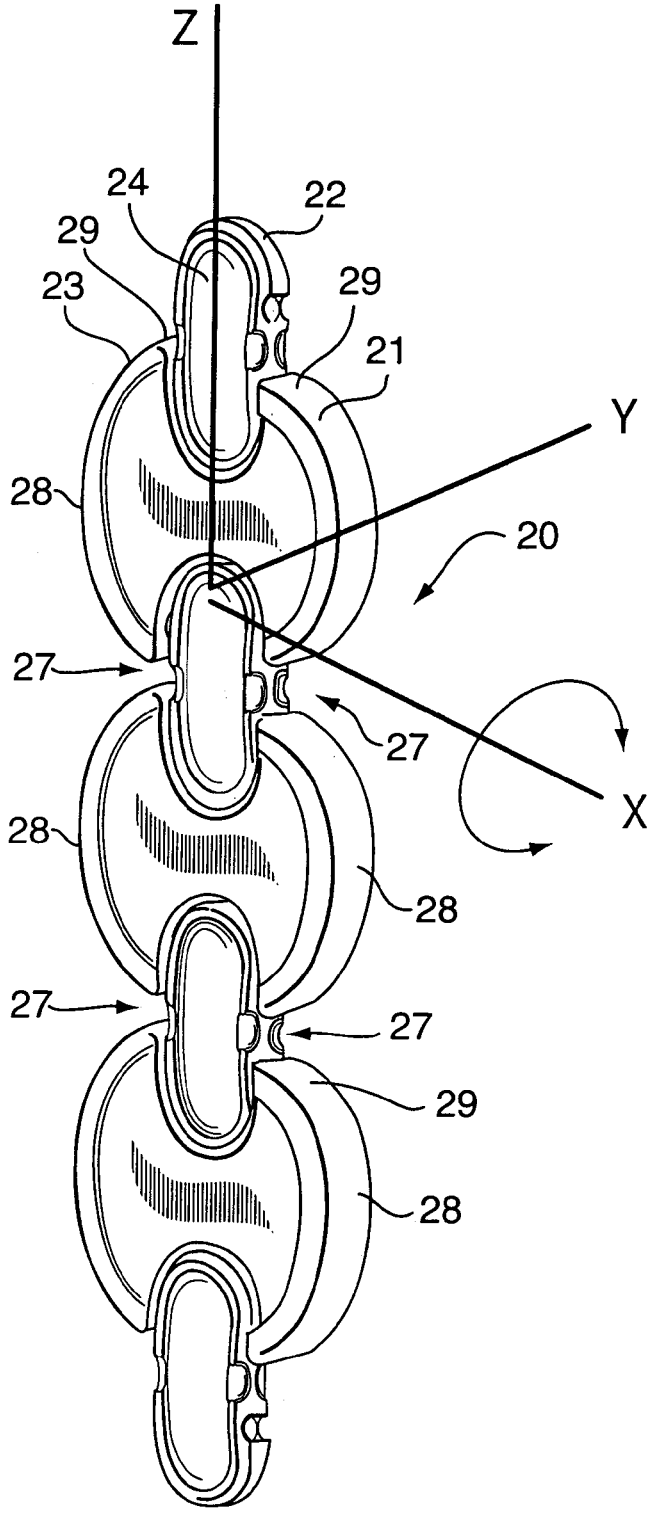
FIGS. 4*a* and 4*b* are perspective views of the flexible drive element, and links thereof, of the embodiment of FIG. 1.

A preferred embodiment of the flexible element 3, taking the form of an ergonomically configured chain 20, is shown in more detail in FIG. 4*a*. The chain consists of rigid individual links 21 and 22 that are shown individually in FIG. 4*b*. The links 21 and 22 are of two different kinds that are shaped to conform ergonomically to the operator's hand and that allow for a grip that reduces operator fatigue and increases user comfort and ease of manipulation of the drive input 1. The links 21 and 22 are in the form of generally flat bodies 23 and 24 provided with smooth rounded edges to ensure user comfort. A textured surface may also be applied to the links to increase the friction between the user's hand and the chain 20 and thus improve grip strength. The links 21 and 22 are also optimally sized for user comfort and secure grip with the larger 21 of the two links sized between 1.25-1.5 inches (3.2-3.8 cm) in width and the smaller 22 being approximately half the width of the larger link or even narrower.

The fact that the links 21 and 22 are of different widths and alternate in sequence along the length of the chain 20 means that the chain has a series of recesses 27 extending at regular intervals inwardly from both side edges 28 of the chain part way through the width of the chain. These recesses 27 are shaped to receive the sprockets 19*a* and 19*b* projecting from the sprocket wheel 18 adjacent to each side edge of the wheel (see FIGS. 3*a* and 3*b*). The shoulders 29 of the larger links 21 abut the sprockets and provide the wheel 18 with a positive drive while allowing the sprockets to disengage the chain without sticking at the point the chain and wheel separate from each other. The smaller links 22 are dimensioned to fit between opposing pairs of sprockets 19*a* and 19*b* so that the chain lies flat against the cylindrical circumferential surface of the wheel 18.

As shown in FIG. 1, the chain 20 is preferably configured such that it remains a comfortable distance away from the patient 2 at all times while remaining accessible to the user. If the flexible element has too many degrees of freedom it may swing and hit the patient in the face or head area during use. The avoidance of this inconvenience is an important preferred feature of the device of the present invention because patient comfort is significant to the acceptance of the device. As shown in FIG. 4*a*, this is achieved by endowing the flexible element with the following characteristics:

It can rotate about the X-axis only (transversely to the longitudinal direction of the flexible element).

It is constrained from rotating to more than a minor amount about the Y axis (twisting laterally about an axis extending at right angles into a face of the chain) and the Z axis (swivelling around the longitudinal axis of the chain when drawn into a straight line).

Figure 4B:
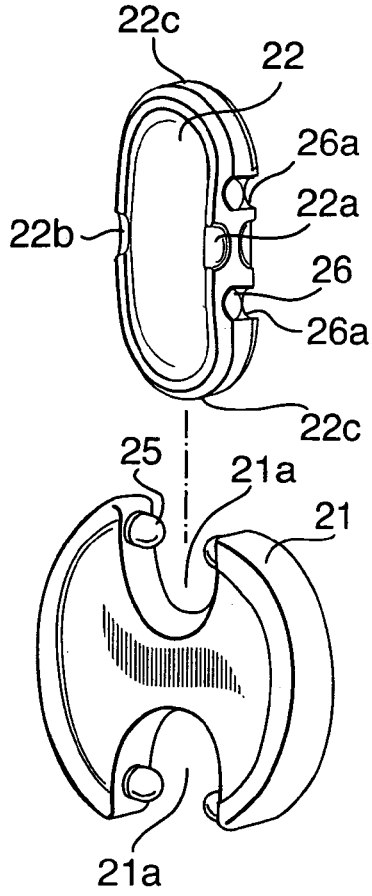

In the case of the chain illustrated in FIGS. 4*a* and 4*b*, the larger links 21 have re-entrant sections 21*a* at each longitudinal end, and the smaller links 22 have ends 22*c* that fit within the re-entrant sections of the larger links. The links 21, 22 are fitted together to allow for free rotation only about the X-axis as shown. Each link can rotate with respect to its adjacent link around the X-axis at the point of attachment. Each link is constrained from rotating with respect to its adjacent link around the Y and Z axes. This effectively ensures that the chain remains in a plane that is offset from the patient's face and head once it is integrated into the device 10.

The links 21, 22 are preferably made as individual finished components from injection molded plastics, with integrated bosses 25 and holes 26 for connecting the links. The links may also be formed by compression molding of plastics, by casting, by machining or by other methods of forming plastics or metals, including metal die casting, investment casting, slip casting or powder injection molding. If the bosses and holes are not made as integral parts at the time of formation of the links, holes may be machined into the links, and the chain may be held together by pins or other fasteners. A surface texture may also be added during the molding process by adding a texture to the mold surface, or the links can be given a texture by other methods like sand blasting, drum tumbling or chemical etching.

The bosses 25 (or pins) and holes 26 are preferably formed in such a way that the links can be snap-fitted together or separated by hand, e.g. by gripping two adjacent links and firmly twisting them about the Z axis of FIG. 4*a*. By this means, the flexible element can be installed on the device 10 or removed very easily and the length of the element can be adjusted to the best length for operation. To facilitate this convenient form of attachment or detachment, the links provided with holes 26 to receive the bosses 25 or pins preferably have cut-outs 26*a* in the material of the walls surrounding the holes that make it easier for the bosses or pins to snap out of, or alternatively to snap into, the holes when desired, while being dimensioned to retain the bosses or pins during normal use of the elongated element. The cut-outs 26*a* are most preferably positioned such that they are remote from the points of abutment between the bosses or pins and the material surrounding the holes when the flexible element 3 is under tension. However, the cut-outs 26*a* are positioned directly in the path of the bosses or pins when adjacent links are twisted firmly about axis Z.

As shown in FIG. 4*b*, the small link 22 has shallow recesses 22*a* in the side edges of the major faces. These recesses allow two adjacent large links 21 to lie directly one on top of the other, by suitably folding the chain, without interference from or binding of the intervening small link 22. Such interference might otherwise cause the links to separate when compressive force is applied to a folded chain, e.g. during packing for storage or transport.

Figure 5:
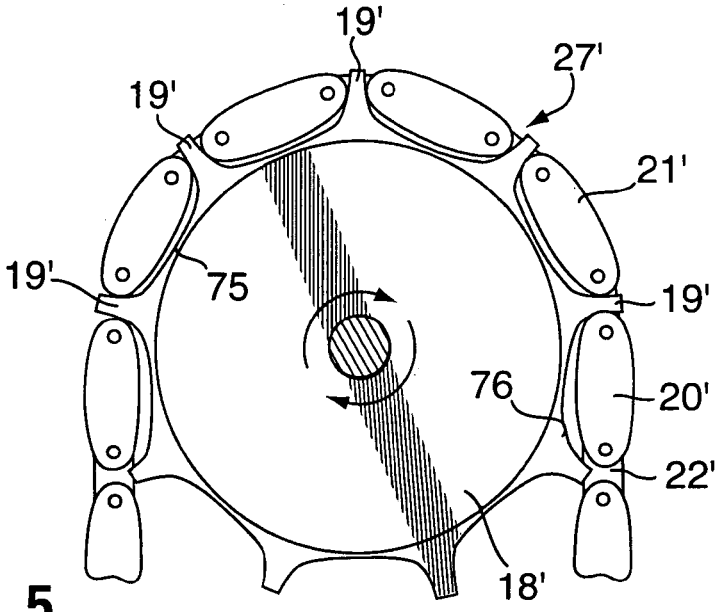
FIG. 5 shows an alternative form of a flexible drive element and sprocket wheel for use in the devices illustrated in the earlier figures.

A flexible element of alternative design and a correspondingly modified sprocket wheel are shown in FIG. 5. This alternative design is intended to make the flexible element 3 even more comfortable for the user to grip and pull. In this design, large links 21' are approximately cylindrical or of a smoothly rounded "jelly bean" shape. The intervening small links 22' may also be of similar shape or may be generally flat and similar to the links 22 of the previous embodiment. The resulting chain 20' feels rather like a smooth thin rope or cord as it is rounded or essentially cylindrical and flexible. However, it still retains the important advantage that adjacent links are freely rotatable only about the "X-axis" as the links are attached in the same manner as the previous embodiment, so that the chain stands clear of the patient's head or body. The chain also works in the same way as the previous embodiment in that the small links 22' joining the large links 21' form pairs of recesses 27' positioned at regular intervals along the length of the chain and these recesses receive and abut the sprockets 19' of sprocket wheel 18'. The engagement of the sprockets and chain is therefore at the two opposed sides of the chain, thus providing an even and secure drive.

In this alternative design, the sprocket wheel 18' is shaped to conform to the shape of the links of the chain. Consequently, the circumference of the wheel has dished pockets 75 between adjacent pairs of sprockets 19' to accommodate the shape of the large links 21', and generally flat regions 76 between the sprockets 19' of adjacent pairs to accommodate the shape of the small links 22', assuming that the small links are essentially flat. The resulting effect is that the chain fits snugly around the sprocket wheel 18' with the sprockets 19' fitting securely into and extending through the recesses 27'.

Spreader Bar Components

Figure 6:
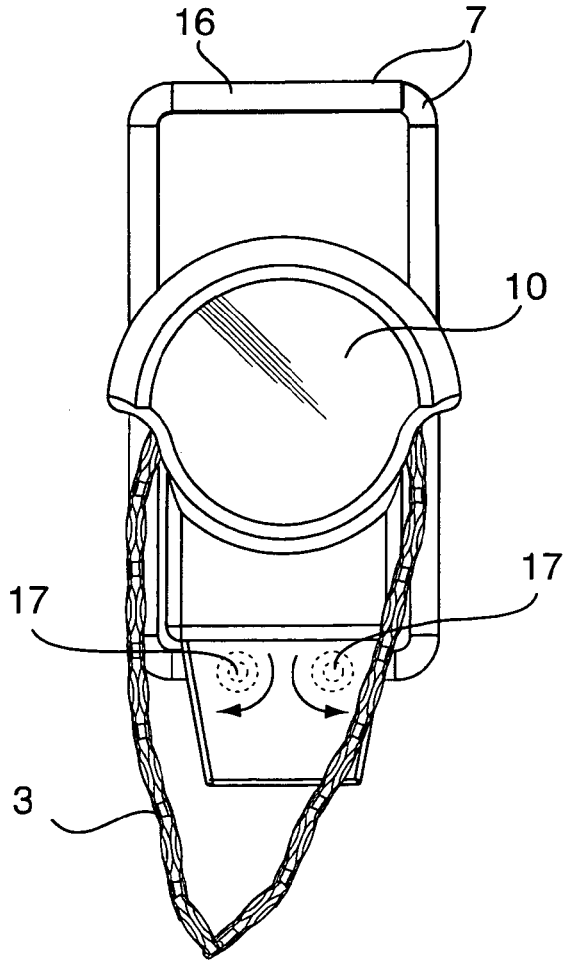
FIG. 6 is a view similar to FIG. 2 showing the spreader bars retracted and pivoted to a stored position.

As shown in FIGS. 2 and 6, the spreader bars 7 (elongated rigid arms acting as a load-carrying support) may be configured so as to be stored in a folded-up position when not in use, e.g. when transporting the device 10 from one location to another. This is achieved by providing left and right spreader bars that can rotate in a vertical plane about two pins 17. Ideally (as shown in FIG. 2), the spreader bars have proximal end sections 7*a*, distal end sections 7*b*, elongated sections 7*c* between the proximal and distal end sections, and elbow sections 7*d* between the proximal end sections and the elongated sections. The elbow sections 7*d* firmly abut against each other when the spreader bars are in the operating position of FIG. 2. The proximal and distal end sections are set at an angle to the elongated sections, the angle preferably being in the range of 45 to 135 degrees, and normally about 90 degrees. The distal end sections 7*b* angled in this way act as "hooks" that prevent straps of a sling 15 or the like from slipping off the spreader bars.

Figure 7A:
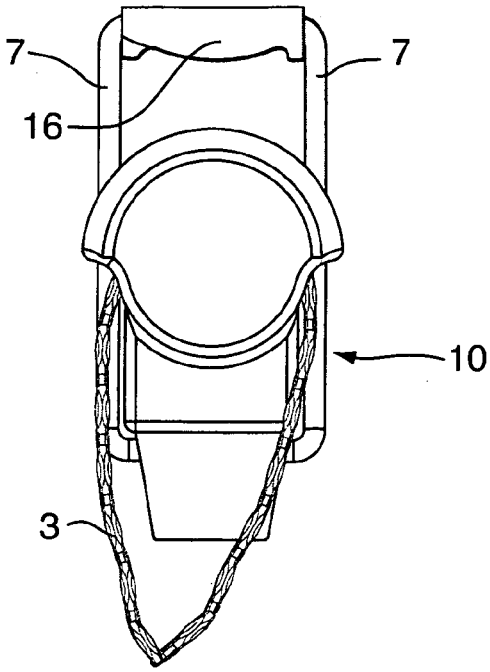
FIGS. 7*a* and 7*b* are views similar to FIG. 6 of a modified embodiment having shaped carrying handles and also showing the device with the spreader bars in the operating (load carrying) position as well as the stored position.
Figure 7B:
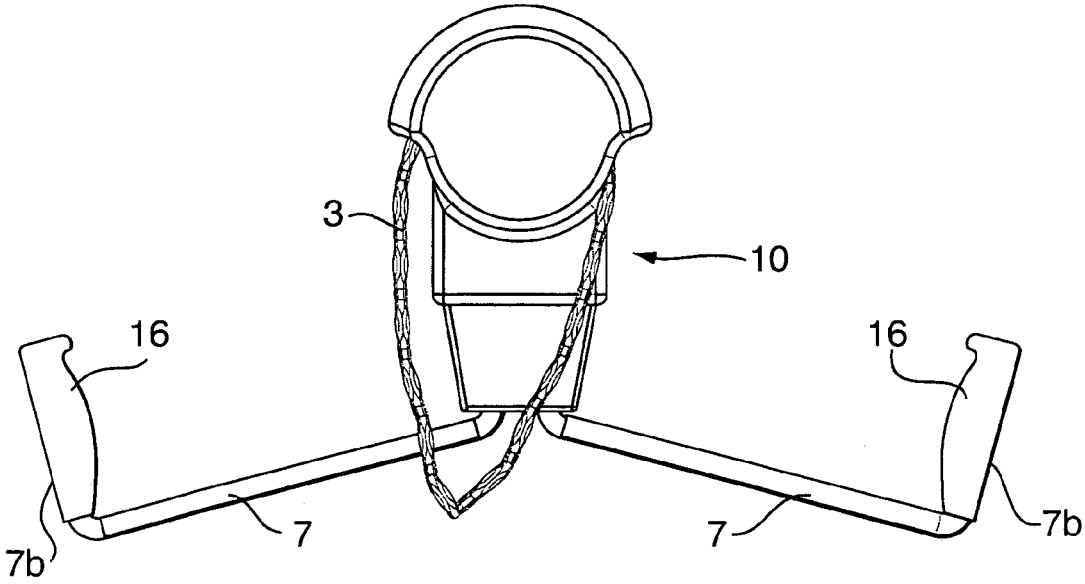

As shown in FIG. 6, the distal ends 7*b* of the spreader bars 7 also function together to form a graspable carrying handle 16 for the device when the spreader bars are rotated to an upright stored position. In this position, the handle 16 is located above the raising and lowering mechanism within the housing 11. As shown more particularly in FIGS. 7*a* and 7*b*, the distal end sections 7*b* of the spreader bars may be ergonomically configured so that together they form a graspable handle 16 that conforms to the shape of the operator's hand, which allows for a grip that reduces operator fatigue while transporting the device 10.

Figure 8:
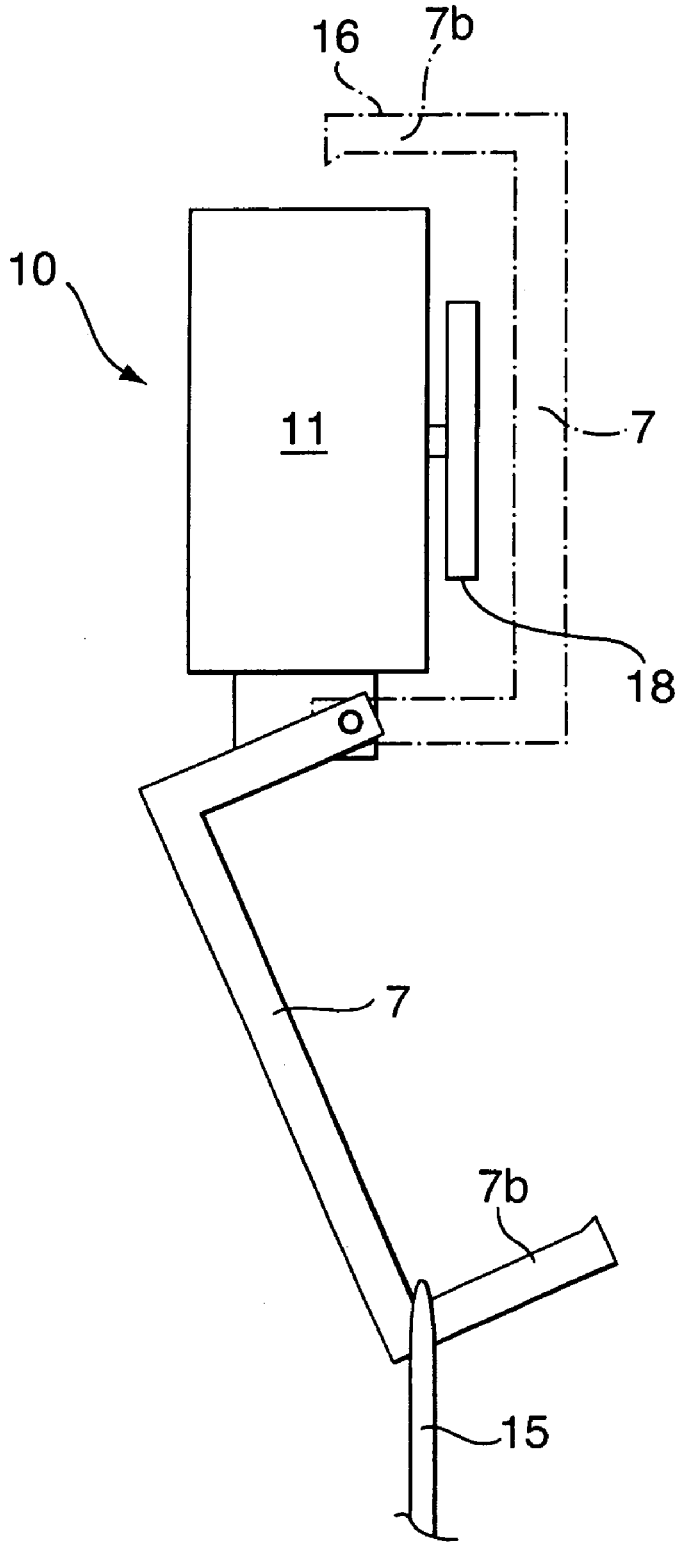
FIG. 8 is a side elevation of a device according to the present invention having a single spreader bar as the load-carrying support.

FIG. 8 shows a device 10 having a single spreader bar 7 centrally pivotally mounted on the housing 11. In the operating position of the spreader bar 7 (shown in solid lines), the spreader bar hangs downwardly and forms a support for a sling 15 or the like. In the stored position (shown in broken lines), the spreader bar 7 is folded upwardly in front of the sprocket wheel 18 and the distal end section 7*b* forms a graspable handle 16 useful for carrying the device. The spreader bar 7 preferably locks in the storage position to facilitate carrying, and can be unlocked when configured for use.

Figure 9:
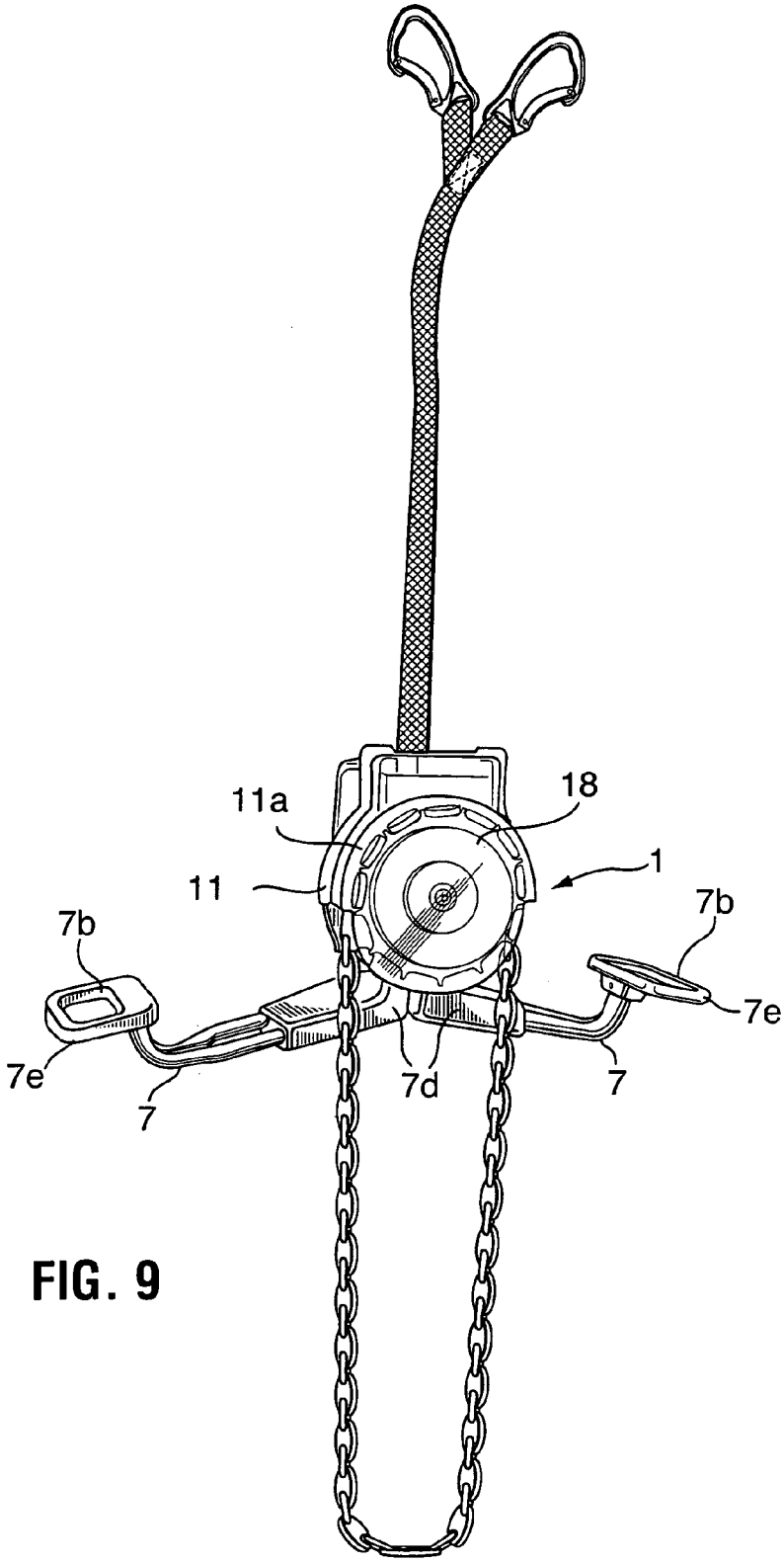
FIG. 9 is a perspective view of a further embodiment of the device shown in the operating position.
Figure 10:
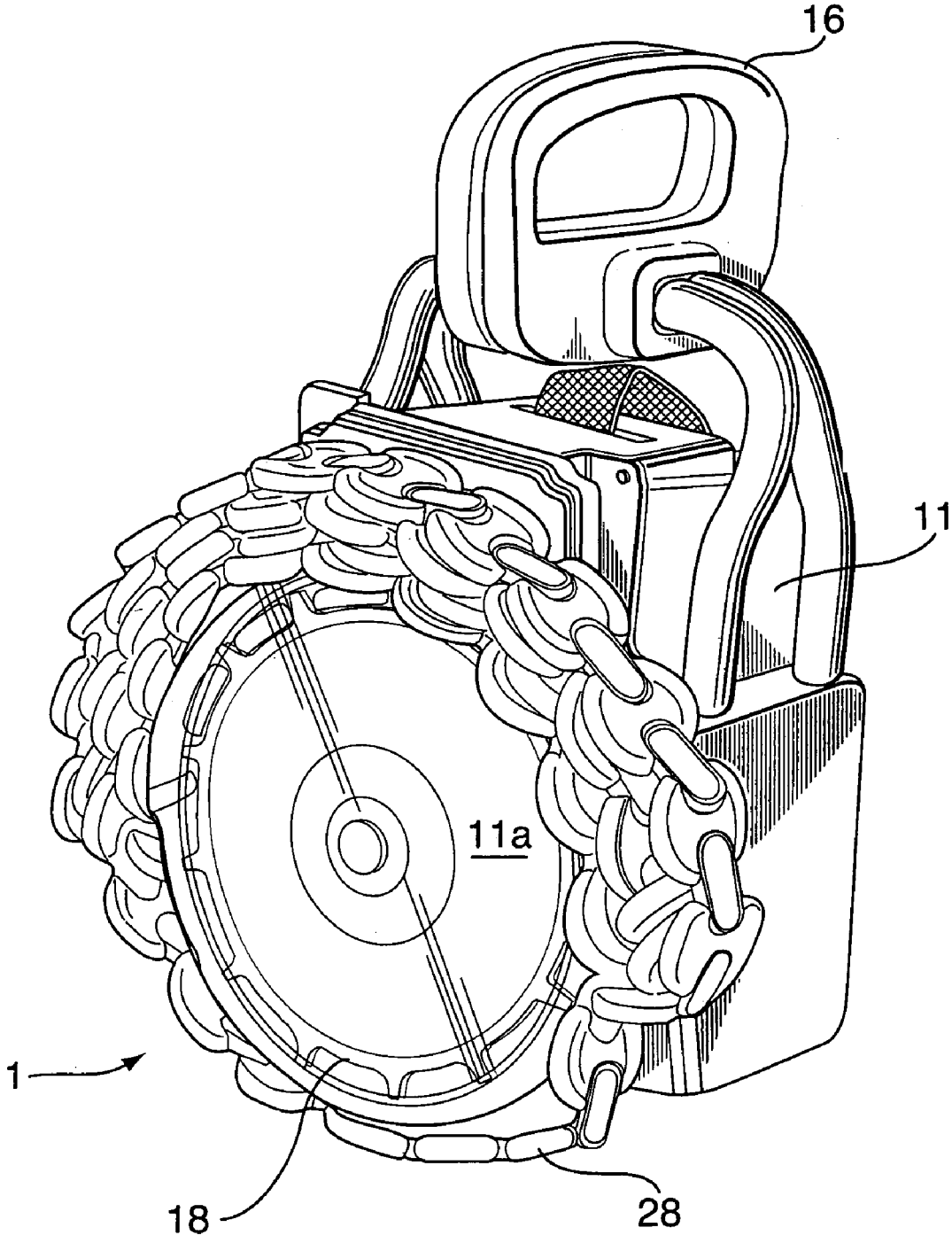
FIG. 10 shows the device of FIG. 9 in the stored position ready for transport.

FIGS. 9 and 10 show an alternative embodiment of the device 10 having a pair of spreader bars 7. FIG. 9 shows the device in the operating position and FIG. 10 shows the device in the stored position ready for storage or transportation. In this embodiment, spreader bars 7 are provided with thickened, reinforced elbow sections 7*d* that abut firmly together when the arms 7 are in their open position to provide secure support for a sling, such as the one shown at 15 in the earlier embodiment. At the distal end sections 7*b*, the spreader bars are provided with generally horizontal plastic loops 7*e* that fit together when the device is in the closed position to form a two parts of a carrying handle 16. In the open position, the loops 7*e* prevent the straps of the sling from slipping off inadvertently. This embodiment is provided with a transparent cover 11*a* at the front of the housing 11 that extends over sprocket wheel 18.

Figure 11:
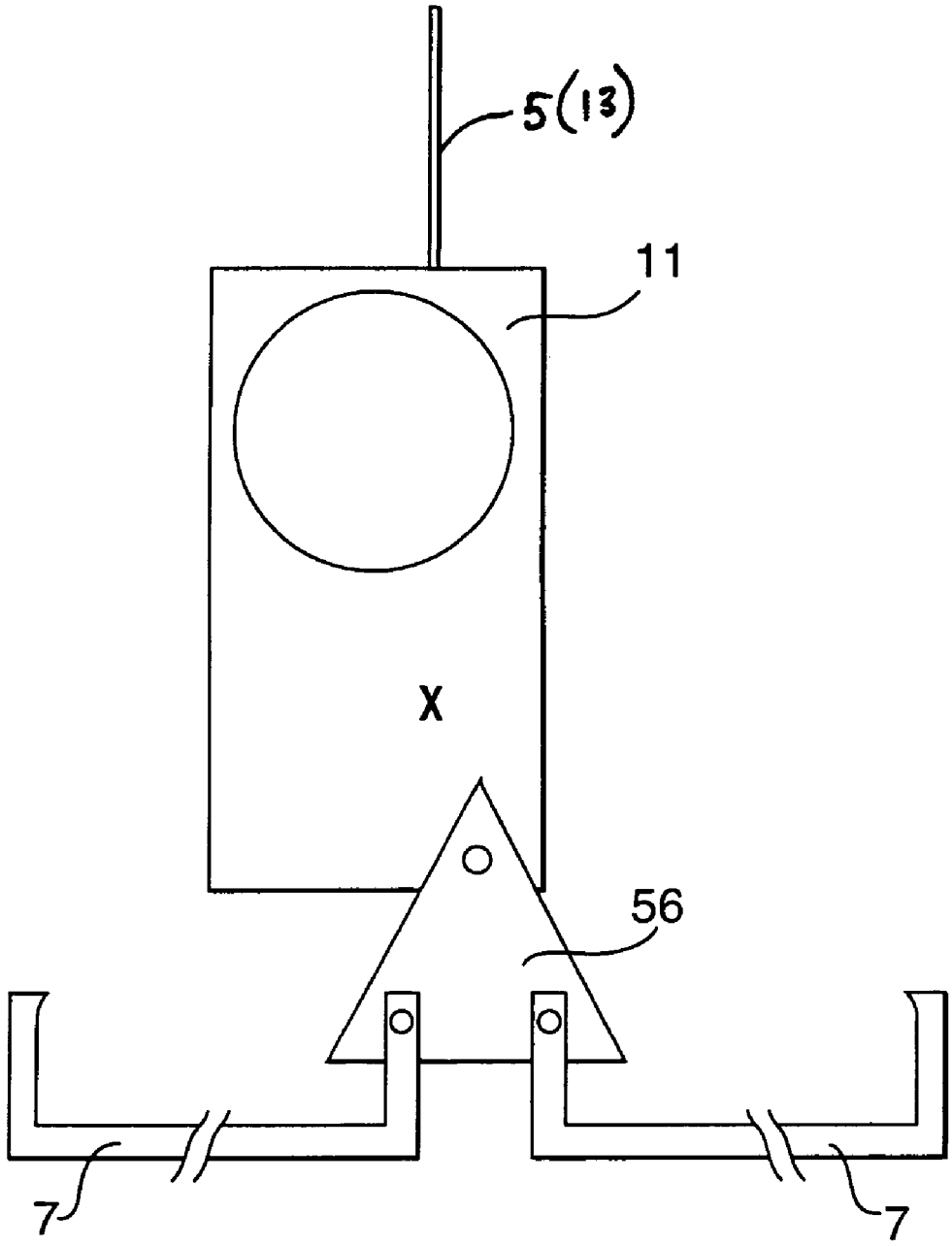
FIG. 11 shows and alternative form of the device having spreader bars attached to a pivoted support plate.

In all of the embodiments of the invention, it is desirable to position the load-carrying support 4, i.e. the spreader bars 7, in relation to the raising and lowering mechanism (i.e. the housing 11 and its contents), the drive input (i.e. sprocket wheel 18 and drive chain 3), and the attachment element 6, in such a relationship that the overall centre of gravity of the device aligns with the attachment element 6 when the spreader bars are in the operating position and aligned with a vertical plane. As illustrated in FIG. 11 (which illustrates yet another embodiment of the invention), this means that the device hangs in a balanced manner without any tilting of the housing 11 forwardly or rearwardly, or to either side, both before a load (patient) is lifted by the device and during such lifting. To achieve this, the spreader bars may have to be positioned towards the rear or one side of the housing 11 to compensate for the weight of the sprocket wheel and chain at the front, or any uneven weight of the internal components within the housing 11. The flexible element 5 (or the connector 13 of FIG. 2) should also be connected to or within the housing 11 at a point directly above the centre of gravity X when the housing is upright and the spreader bars 7 are in the operating position.

To further ensure that the device hangs in an upright manner, the spreader bars 7 may be pivotally attached to a connector member (suspension plate) 56 that is itself pivotally attached to the housing 11. This ensures that the spreader bars may remain horizontal in the operating position, even if the housing tilts to one side or the other for some reason, e.g. when the user pulls down on one side or other of the flexible element 3.

Noiseless Reduction Gear Mechanism

Figure 12:
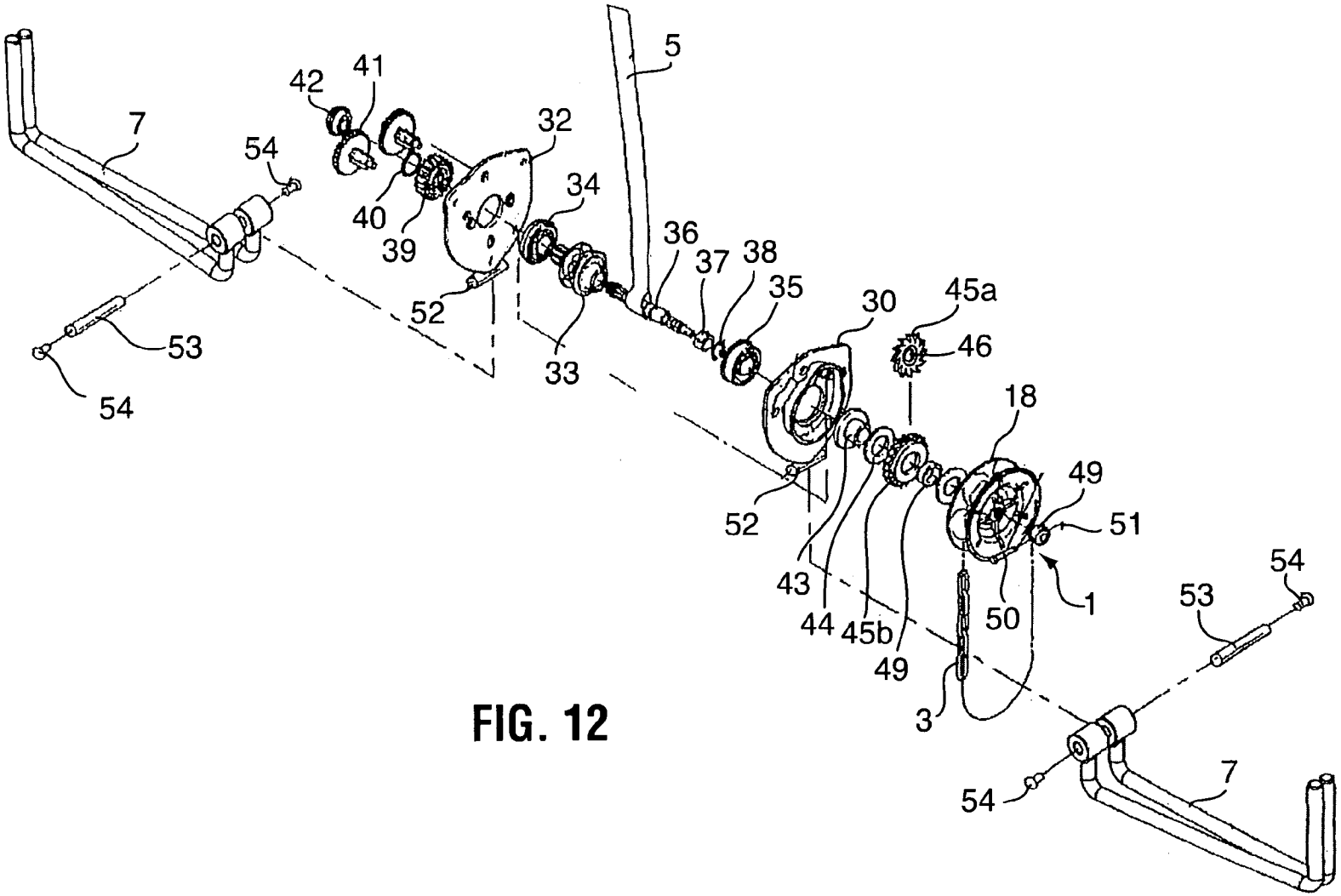
FIG. 12 is an exploded view of one embodiment of a lifting and lowering mechanism according to the present invention.

FIG. 12 shows an exploded assembly drawing of one embodiment of the internal components forming a raising and lowering mechanism suitable for use in the present invention, as well as pivotable spreader bars 7 and drive input 1, 3. The mechanism and spreader bars 7 are supported by a pair of side plates 30 and 32 that may be located within a housing (not shown). The plates 30 and 32 have lower attachment points in the form of spreader bar sleeves 52 for the spreader bars 7. The spreader bars are pivotally attached to the spreader bar sleeves via attachment pins 53 and friction end caps 54. A flexible elongated member 5 (e.g. a fabric belt or strap) has a loop at the lower end that passes around a pinion 36 and is wound on or off the pinion when the pinion rotates in one direction or the other. The pinion 36 thus forms a reel component for the flexible elongated member 5. The pinion passes through a load sheave 33 and ball bearing 34 at one end and through a roller bearing 37 and ball bearing 35 at the other end. Snap rings 38 and 40 keep these elements in place. The pinion 36 operates a load gear 39 which cooperates with a gear number 2 assembly 41 provided with a ball bearing 42. The gearing is intended to enable a relatively gentle pull on a flexible element 3 to turn wheel 18 and to wind in the flexible elongated member 5 even when a considerable weight is suspended from the spreader bars 7. The equipment of the raising and lowering mechanism is completed by a bushing 47, a wheel stopper 49 held in place by a wheel stopper pin 50 and split pin 51.

This kind of gear train is normally provided with a ratchet and pawl type mechanism that allows the gears to rotate in one direction only, i.e. in the direction that allows the patient to be lifted. However, such mechanisms are very noisy and distracting, and can be dangerous when used for lifting animals as animals may be startled and panicked by the noise.

Figure 13:
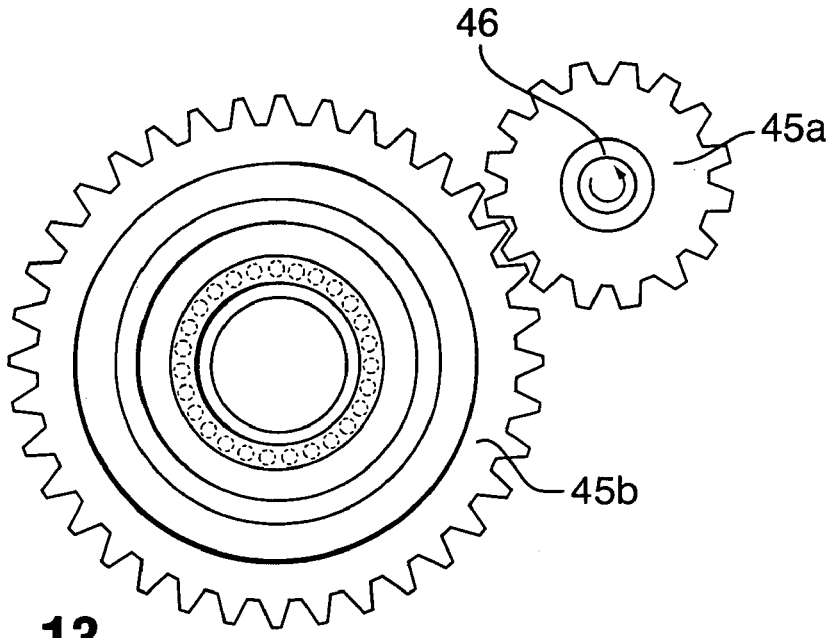
FIG. 13 is a view of parts of the mechanism of claim 12 particularly illustrating a one-way roller bearing.

Instead of using a ratchet and pawl mechanism, the present invention incorporates a one-way roller bearing 46 supporting a reverse prevention gear 45*a* (shown more clearly in FIG. 13). The reverse prevention gear permanently engages a running gear 45*b* forming part of the main gear train. Essentially, the reverse prevention gear 45*a* rotates with the running gear 45*b* as the wheel 18 is used for lifting and this rotation is permitted by the one-way roller bearing 46. When rotation in this direction is stopped, lowering of the load is prevented because the one-way roller bearing 46 does not allow rotation of the reverse prevention gear 45*a*, which in turn prevents rotation of the running gear 45*b* in the reverse direction. Consequently, the load suspended from the spreader bars 7 remains stationary at a fixed elevation. The one-way roller bearing 46 operates essentially without noise and thus eliminates the annoying clatter of a conventional ratchet and pawl mechanism.

Nevertheless, the cooperating friction disc 43 and friction plate 44 make it possible to lower a load when desired. The friction disc 43 and friction plate 44 together act as a friction clutch normally causing the running gear 45*b* to rotate when the sprocket wheel 18 rotates. One of these elements is attached to the running gear 45*b* and the other is attached to the remainder of the gear train extending from sprocket wheel 18 to pinion 36. Thus, mutual slippage between these elements permits the gear train to be moved in the reverse direction even when the running gear 45*b* is held stationary by the reverse prevention gear. The frictional force is made such that it is not exceeded by the torque applied by the maximum load likely to be supported by the device, but is less than the torque that can be applied by a combination of the load and a force exerted by pulling on the flexible element 3 in the reverse (lowering) direction. Thus, the load can be lowered from a fixed suspended position in a controlled manner by reversal of the rotation of the wheel 18 that causes slippage between elements 43 and 44. Again, this lowering mechanism operates essentially without noise and the patient can be lowered to any desired elevation and held there.

Further noise reduction can be achieved, if needed, by making use of gears (at least the main load-bearing gears) made of tough plastics rather than metal.

Figure 14A:
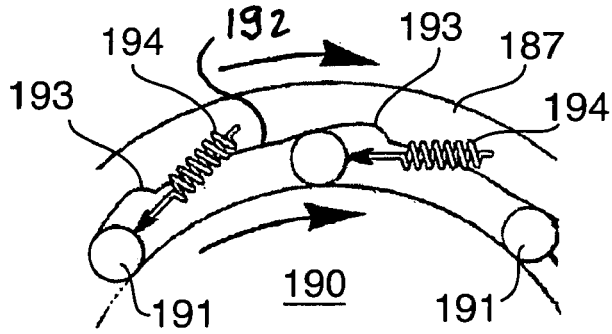
FIGS. 14*a* and 14*b* are partial views showing operation of a needle roller race used in the mechanism of FIG. 12.
Figure 14B:
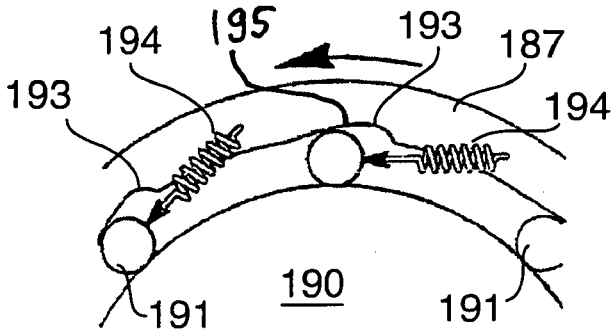

The manner in which the one-way roller bearing 46 operates is shown in the enlarged partial cross-sections of FIGS. 14*a* and 14*b*. The roller bearing receives, and is supported by, a stub axle 190 that is itself fixed against rotation. The bearing includes needle rollers 191 forming a needle roller race that surrounds and supports the axle 190 within a surrounding bearing shell 187 on which the gear 45*a* is mounted. When rotation of the shell is in the direction shown by the arrows in FIG. 14*a*, the rollers 191 are pushed towards enlargements 193 in the inner surface of the shell 187, so that there is no binding between the axle 190 and the shell 187. When the direction of rotation is as shown by the arrow in FIG. 14*b*, the rollers 191 are pushed in the direction of the narrow lands 192 between the enlargements 193. The lands 192 are too narrow to fully receive the rollers 191 and the rollers are causes to bind between the stub axle 190 and the sloping walls 195 of the shell 187, thus preventing further rotation in this direction. The springs 194 acting between the rollers 191 and the shell 187 bias the rollers towards the enlargements 193 so that there is less tendency for the rollers to continue to bind when the direction of rotation is changed from that of FIG. 14*b* to that of FIG. 14*a*.

The apparatus shown in FIG. 12, apart from the reverse prevention gear 45*a* and one-way roller bearing 46, as well as the pivotable spreader bars 7 and flexible element 3, is essentially the same as the mechanism of commercially available Kito CB Series Chain Hoist (Model M3) from Kito Corporation of Tokyo, Japan. This known hoist uses a ratchet and pawl mechanism previously discussed. However, other raising and lowering mechanisms well known in the art may be employed, provided they are capable of modification in the manner indicated above. For example, the mechanism of U.S. Pat. No. 788,606 may be suitable.

It will be noted in the embodiment of FIG. 12 that the spreader bars 7 extend at right angles to the plane of the sprocket wheel 18 whereas, in other embodiments, the spreader bars 7 extend parallel to the plane of the sprocket wheel 18 (which is the more preferred arrangement). Also, the embodiment of FIG. 12 does not include a magnetic clutch nor the specialized drive chain (described elsewhere in this application).

Magnetic Clutch

Figure 15:
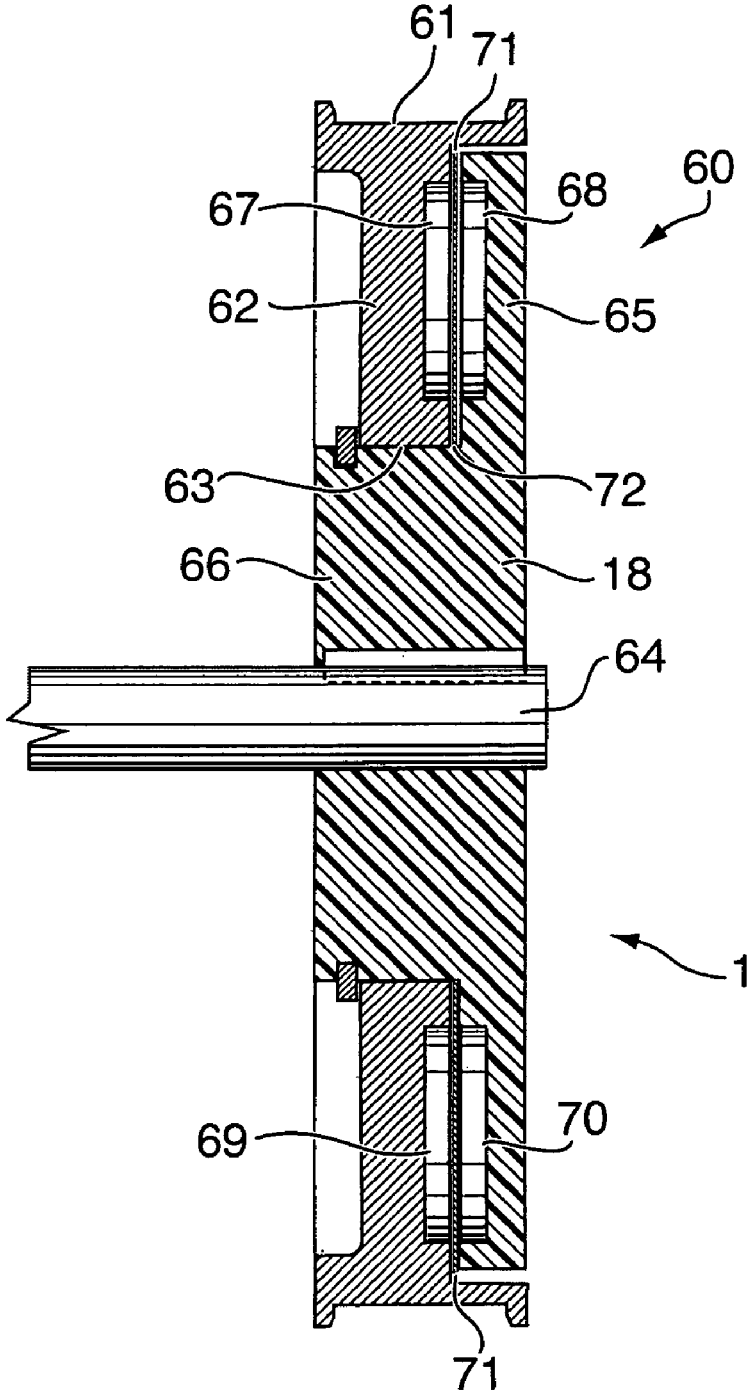
FIG. 15 is a vertical cross-section of a magnetic clutch employed in a preferred form of the device of the present invention.
Figure 16:
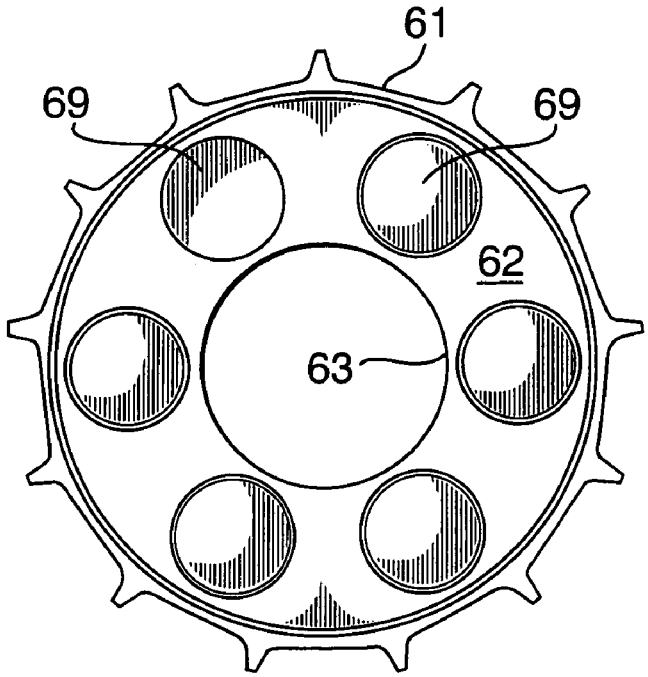
FIG. 16 is a front view of one component of the magnetic clutch of FIG. 15.
Figure 17:
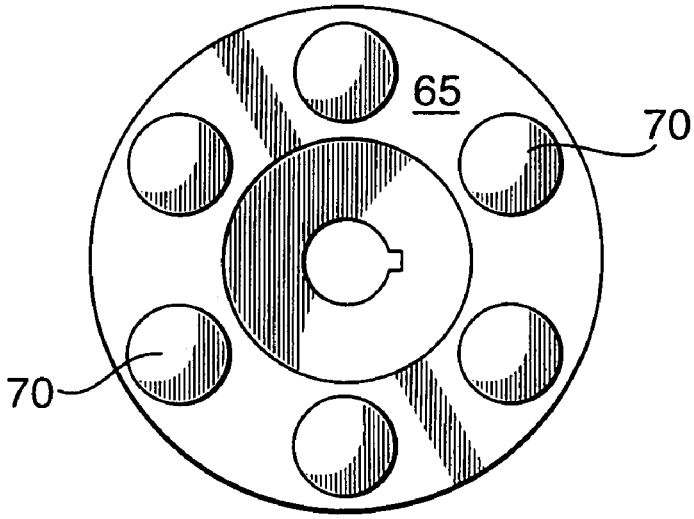
FIG. 17 is a front view of a second component of the magnetic clutch of FIG. 15.

A preferred form of the device 10 of the present invention includes a magnetic clutch 60 shown in more detail in FIGS. 15, 16 and 17. FIG. 15 is a cross-section of the assembled clutch and FIGS. 16 and 17 show parts thereof.

The clutch 60 is provided in order to prevent damage to the raising and lowering mechanism if an attempt is made to lift a weight that is too heavy for the device. In such a case, the clutch slips harmlessly, preventing lifting from taking place, thus temporarily isolating the raising and lowering mechanism from the drive input 1.

The clutch 60 is preferably incorporated into the sprocket wheel 18 that is driven by the flexible element 3 (e.g. as shown in FIG. 3). The sprocket wheel 18 has an outer circumferential surface (rim) 61 and an annular wall 62 provided with a central hole 63 that receives a central shaft 64 leading to a gear train of the raising and lowering mechanism (not shown). The annular wall 62 acts as a drive input clutch plate as it is driven by the flexible element operated by the user. A disc 65 extends peripherally from a central hub 66 that is keyed to the shaft 64 for positive rotation with the shaft. The hub extends snugly through the central hole 63 of the annular wall 62 and the annular wall may rotate on the outer surface of the hub. The disc 65 forms a driven or follower clutch plate. Both the annular wall 62 and the disc 65 are formed with depressions 67 and 68, respectively, that extend partially through the thickness of the annular wall and drive disc. The depressions 67 and 68 are filled with flat circular magnets 69 and 70, respectively, that lie flush with the adjacent surfaces of the adjacent annular wall or disc. A thin plastic separator disc 71 is located between the annular wall 62 and the disc 65. This disc 71 has a central hole 72 that is not keyed to the hub 66 and is free to rotate or to remain stationary. The annular wall 62 and disc 65 thus form a pair of rotatable elements that are capable of being rotatable independently of each other but have confronting parts that are magnetically attractive-and thus tend to rotate in unison until the attractive force is exceeded.

The magnets 69 and 70 are preferably positioned such that the magnets 69 in the annular wall 62 all align with the magnets 70 in the disc 65 and face each other on opposite sides of the separator disc 71. The magnets are preferably symmetrically arranged around the axis of the central shaft 64 at equal spacings from the axis. The magnetic poles are arranged for mutual attraction of the magnets across the separator disc and their magnetic strength is sufficient to hold the disc 65 firmly to the annular wall 62 during normal operation of the equipment. In this case, rotation of the wheel 18 by the flexible element 3 causes equivalent rotation of the disc 65. The disc 65 in turn, being keyed to the shaft 64, causes rotation of the shaft and operation of the gear train. However, if the weight on the device reaches an overload cut-off value, slippage may occur between the annular wall 62 and the disc 65 because the magnetic force holding these two elements together is exceeded. This slippage is facilitated by the presence of the separator disc 71 which has a low friction surface. The disc is thin enough, however, that the magnetic attraction is not significantly attenuated across the disc. As the magnets are arranged in a symmetrical fashion around the annular wall and drive disc, the magnets will realign after one sixth of a rotation (as there are six magnets in this embodiment). If the weight on the device has been decreased at this time, the magnetic attraction will then cause the annular wall and drive disc to rotate as one. If the weight still exceeds the overload cut-off, these elements will again slip relative to each other until the weight is reduced. The magnetic clutch thus re-sets itself automatically and requires no attention following reduction of weight on the device.

The torque at which the clutch slips can be varied (if required) by varying the number of magnets 69, 70 and/or by increasing or decreasing the magnetic attraction between the magnets (either by using magnets of different magnetic strength, or by increasing or deceasing the thickness of the separator disc 71). For example, a simple way of varying the slippage torque is to remove some of the magnets from one side of also be advantageous for some embodiments of the invention to arrange the magnets asymmetrically around the shaft 64 or in a manner than not all magnets confront each other.

It will be appreciated from the description above that the magnetic clutch fits completely within the outline of the sprocket wheel 18 of the drive input 1, with one of the clutch elements being part of the sprocket wheel itself and the other being a disc fitting within a recess formed within the sprocket wheel. The clutch therefore takes up no additional space and its weight is kept to a minimum.

The invention claimed is:

1. A raising and lowering device provided with a raising and lowering mechanism, an attachment element adapted to enable the device to be suspended from an elevated support, and a load-carrying support adapted to support a load to be raised or lowered by said mechanism, wherein the load-carrying support comprises a pair of vertically pivotable arms having proximal sections positioned adjacent each other, elongate sections extending therefrom said proximal sections terminating in distal sections, wherein said anus have elbow sections where said proximal end sections join said elongated sections, and wherein said elbow sections abut against each other when said arms are pivoted downward into an operating position, thereby preventing further downward pivotal motion of said arms, and a stored position in which the distal section of one of said arms forms a graspable handle allowing an operator to carry the device.

2. The device of claim 1, wherein said distal end sections of said pair of arms together form a graspable handle when said arms are in said stored position.

3. The device of claim 1, wherein said distal end sections of said arms are oriented at an angle to said elongated sections, thereby forming upward projections from said elongated sections when said arms are in said operating position.

4. The device of claim 3, wherein said angle is in the range of 45 to 135 degrees.

5. The device of claim 1, wherein said proximal end sections of said arms are orientated at an angle to said elongated sections, thereby forming upward projections from said elongated sections when said arms are in said operating position.

6. The device of claim 1, wherein, during operation of the device, the load-carrying support is positioned beneath said raising and lowering mechanism, wherein said arms move in a vertical plane when pivoted from said operating position to said stored position, and wherein said distal end sections are positioned above said raising and lowering mechanism when said arms are in said stored position.

7. The device of claim 1, wherein said attachment element is connected to said raising and Lowering mechanism by an elongated flexible support member, and wherein said raising and lowering mechanism is adapted to draw said flexible support member into said mechanism to raise said load-carrying support, and to feed said flexible support member out of said mechanism to lower said load-carrying support.

8. The device of claim 1, wherein said elongated arms and said attachment element are positioned on the device in relation to said raising and lowering mechanism to allow said device to hang vertically from an elevated support without tilting.

9. The device of claim 1, wherein said proximal ends of said elongated arms are pivotally attached to a connector member that is itself pivotally attached to said raising and lowering mechanism.

10. The device of claim 1, wherein said raising and lowering mechanism is adapted to be operated manually.

11. The device of claim 1, wherein said raising and lowering mechanism has a drive input adapted to be driven by a detachable electric motor.

12. The device of claim 1, wherein said raising and lowering mechanism is operated by a drive input comprising a rotatable wheel that operates the mechanism when turned, and wherein a flexible element passes around said wheel and forms a dangling loop that is adapted to be grasped and moved by hand.

13. The device of claim 12, wherein said wheel is a sprocket wheel having projecting circumferential sprockets, and wherein said flexible element is a chain having recesses for receiving said sprockets.

14. The device of claim 13, wherein said chain comprises two different kinds of links, the links of the two kinds being arranged in alternating sequence along said chain and being pivotally attached to each other in a way that allows adjacent links to be oriented to be coplanar or mutually pivoted about axes that are transverse to the chain, and the links of one of said two kinds being wider in a lateral direction of the chain than the links of the other of said two kinds, thereby creating lateral recesses in side edges of the chain at spaced locations along the chain, and wherein said sprockets project in aligned pairs at opposite edges of a circumference of said sprocket wheel in positions adapted to enter and engage with said recesses as said chain passes around said wheel.

15. The device of claim 14, wherein adjacent links are pivotally attached to each other by laterally extending coaxial pairs of bosses or pins extending between said links.

16. The device of claim 15, wherein at least one of said adjacent links has sockets for receiving and retaining ends of said bosses or pins, and wherein said sockets have cut-outs allowing snap-fitting together or, alternatively, manual separation of said adjacent links by mutual twisting of said adjacent links.

17. The device of claim 14, wherein said links are made of a rigid plastics material.

18. The device of claim 14, wherein said links are made of metal.

19. The device of claim 14, wherein said links have outer surface provided with a non-slip finish.

20. The device of claim 14, wherein the links of one of said two kinds are provided with re-entrant sections at each longitudinal end, and wherein said links of the other of said two kinds are elongated and have opposed ends shaped and dimensioned to fit within said re-entrant sections of the links said one kind.

21. The device of claim 20, wherein adjacent links are mutually pivotally attached by bosses or pins extending between said links within said re-entrant sections.

22. The device of claim 20, wherein the links of said other kind are shaped such that two links of said one kind attached at opposite ends of a link of said other kind are enabled to pivot into mutual contact without causing detachment of said pins or permanent deformation of said links.

23. The device of claim 1, wherein said raising and lowering mechanism includes a one-way roller bearing for an axle and an axle journaled in said bearing, said bearing allowing mutual rotation between said bearing and said axle in one direction consistent with raising of said load, but preventing mutual rotation in an opposite direction consistent with lowering of said load, thereby enabling said load to be raised to any desired elevation by operation of said raising and lowering mechanism and held at said elevation without lowering upon ceasing operation said raising and lowering mechanism.

24. The device of claim 1, wherein said raising and lowering mechanism is provided with a drive input and a magnetic clutch between said drive input and said raising and lowering mechanism that prevents overload of the raising and lowering mechanism by said drive input.

25. A raising and lowering device provided with a raising and lowering mechanism, an attachment element adapted to enable the device to be suspended from an elevated support, a load-carrying support adapted to support a load to be raised or lowered by said mechanism, a pair of vertically pivotable arms having proximal sections positioned adjacent each other, elongate sections extending therefrom said proximal sections terminating in distal sections, wherein said arms have elbow sections where said proximal end sections join said elongated sections, and wherein said elbow sections abut against each other when said arms are pivoted downward into an operating position, thereby preventing further downward pivotal motion of said arms, a drive input for said mechanism and a magnetic clutch between said drive input and said mechanism, said magnetic clutch being adapted to isolate said mechanism from said drive input when a load of more than a predetermined weight is carried by said load-carrying support and lifting of said weight is attempted.

26. The device of claim 25, wherein said magnetic clutch comprises a pair of elements that are rotatable independently of each other, said elements having confronting parts that are mutually magnetically attractive, one of said elements being operably connected to said drive input and the other of said elements being operably connected to said raising and lowering mechanism.

27. The device of claim 26, wherein said elements are provided with depressions containing magnets forming said confronting parts.

28. The device of claim 27, wherein said elements are rotatable about aligned axes and said magnets are positioned around each element at substantially equal distances from said axes.

29. The device of claim 25, wherein said elements are separated by a spacer element tat facilitates mutual rotation of said plates when lifting of said weight is attempted.

30. The device of claim 28, wherein said elements are discs provided with confronting surfaces, each having the same number of depressions spaced evenly around said axes.

31. The device of claim 25, wherein said drive input comprises a sprocket wheel and one of said elements is an integral part of said sprocket wheel.

32. The device of claim 31, wherein the other of said elements is a disc fitting within a recess formed in said sprocket wheel and confronting said integral part.

33. A raising and lowering device provided with a raising and lowering mechanism, and a load-carrying support adapted to support a load to be raised or lowered by said mechanism, a pair of vertically pivotable arms having proximal sections positioned adjacent each other, elongate sections extending therefrom said proximal sections terminating in distal sections, wherein said arms have elbow sections where said proximal end sections join said elongated sections, and wherein said elbow sections abut against each other when said arms are pivoted downward into an operating position, thereby preventing further downward pivotal motion of said arms, wherein said raising and lowering mechanism includes a one-way roller bearing for an axle and an axle journaled in said bearing, said bearing allowing mutual rotation between said bearing and said axle in one direction consistent with raising of said load, but preventing mutual rotation in an opposite direction consistent with lowering of said load, thereby enabling said load to be raised to any desired elevation by operation of said raising and lowering mechanism and held at said elevation without lowering upon ceasing operation of said raising and lowering mechanism.

34. The device of claim 33, wherein said one-way bearing comprises a needle race formed of a plurality of needle rollers positioned between said axle and an encircling bearing shell, said encircling bearing shell having a surface confronting said needle race provided with a succession of recesses separated by lands, whereby mutual rotation of said axle and said bearing in one direction biases said individual rollers to enter said recesses, and mutual rotation in an opposite direction biases said individual rollers to contact said lands, thereby preventing rotation.

35. A raising and lowering device provided wit a raising and lowering mechanism, a load-carrying support adapted to support a load to be raised or lowered by said mechanism, a pair of vertically pivotable arms having proximal sections positioned adjacent each other, elongate sections extending therefrom said proximal sections terminating in distal sections, wherein said arms have elbow sections where said proximal end sections join said elongated sections, and wherein said elbow sections abut against each other when said arms are pivoted downward into an operating position, thereby preventing further downward pivotal motion of said arms, and a drive input for said raising and lowering mechanism, wherein said drive input includes a sprocket wheel having outwardly projecting sprockets that operates the raising and lowering mechanism when turned, and an elongated flexible element that engages the sprocket wheel and forms a dangling loop that can be grasped by a user and pulled to turn said sprocket wheel in one direction or another.

36. The device of claim 35, wherein said sprocket wheel has a circumferential surface with said sprockets projecting at regularly spaced positions around said circumferential surface, some of said sprockets being positioned at one side of said circumferential surface and others of said sprockets being positioned at another side of said circumferential surface, said sprockets on said one side and said sprockets on said another side being arranged in aligned pairs.

37. The device of claim 36, wherein said flexible element is an elongated element having opposed side edges provided with regularly spaced mutually aligned recesses adapted to receive said aligned pairs of sprockets of said sprocket wheel.

* * * * *